US006158342A

United States Patent [19]

Moore

[11] Patent Number: 6,158,342

[45] Date of Patent: Dec. 12, 2000

[54] PAPER SUPPLY ADJUSTMENT MECHANISM

[75] Inventor: Mark W. Moore, Highlands Ranch, Colo.

[73] Assignee: Axiohm Transaction Solutions, Inc., Ithaca, N.Y.

[21] Appl. No.: 09/406,156

[22] Filed: Sep. 27, 1999

[51] Int. Cl.[7] ..... B41F 1/28

[52] U.S. Cl. ..... 101/407.1; 400/693

[58] Field of Search ..... 101/407.1, 212; 242/596.1, 596.7; 400/693.1, 693, 692

[56] References Cited

U.S. PATENT DOCUMENTS

| | | | |
|---|---|---|---|
| 4,105,168 | 8/1978 | Rutherford | 242/55.2 |
| 4,860,031 | 8/1989 | Lejcek | 346/136 |
| 5,025,998 | 6/1991 | Hutzenlaub et al. | 242/55 |
| 5,060,076 | 10/1991 | Curley | 358/296 |
| 5,201,588 | 4/1993 | Sakai et al. | 400/693 |
| 5,486,259 | 1/1996 | Goodwin et al. | 156/384 |
| 5,651,624 | 7/1997 | Passer | 400/693 |
| 5,813,343 | 9/1998 | Harb | 101/407.1 |
| 5,904,429 | 5/1999 | Goodwin et al. | 400/693 |

*Primary Examiner*—John S. Hilten
*Assistant Examiner*—Anthony H. Nguyen
*Attorney, Agent, or Firm*—Salzman & Levy

[57] ABSTRACT

A mechanism for a label printer that automatically locks two, spaced-apart, paper supporting guides. A supply roll of paper is disposed between the guides, and the guides are adjusted to a proper paper width position. The guides are each mounted on a rack that engages a centralized pinion gear disposed in the cover plate that is closed over the printer housing. The guides are locked in an adjusted position when the cover is latched to the housing of the label printer.

1 Claim, 4 Drawing Sheets

PAPER SUPPLY ADJUSTMENT MECHANISM

FIELD OF THE INVENTION

The invention pertains to receipt and label printers and, more particularly, to a self-locking, paper supply width adjustment mechanism for a receipt and label printer.

BACKGROUND OF THE INVENTION

In U.S. Pat. No. 5,813,343, issued to Harb on Sep. 29, 1998 for PRINTING MEDIA ROLL MOUNTING AND POSITIONING MECHANISM, a device is illustrated for mounting a supply roll of paper into a computer driven printer. The device features an adjustable mounting for different sizes of thermal paper rolls used for printing labels. The device features two, spaced-apart holders or guides for supporting the thermal paper roll. The holders are each mounted on a rack that engages a centralized pinion gear disposed in the paper mounting cavity. Rotation of the pinion gear draws the paper mounting holders toward and away from each other, thus justifying the roll. The spaced-apart holders are biased towards each other, within the paper mounting cavity, by means of a tensioned, coil spring. The spring is attached to a rack supporting one of the paper holders on one distal end, and to the printer frame on the other distal end.

The present invention differs from the above device of the aforementioned patent, in that the paper holders or guides are mounted upon the cover plate or door of the printer. The spring-biased, rack and pinion adjustment mechanism is mounted within the cover plate. A mechanism is attached to the hinge of the cover plate, which locks the paper adjustment guides in place when the cover plate is closed over the internal, paper receiving cavity.

The locking mechanism comprises a hinge pin that fits in the hinge of the cover plate. The hinge pin is fixed to the frame or housing of the printer, and comprises a camming surface. A pawl disposed in the cover plate is engaged by the camming surface of the hinge pin as the cover plate is closed over the paper receiving cavity. The pawl pushes against a second set of racks attached to the supply roll guides. The second set of racks are locking racks that comprise a fine mesh of teeth. The fine mesh of teeth, when mated together, prevents the guides from moving apart with respect to each other. These racks lock the supply roll guides in their paper size adjusted position.

SUMMARY OF THE INVENTION

In accordance with the present invention, there is provided a label printer having a mechanism that automatically locks two, spaced-apart, paper supporting guides or holders. A supply roll of paper is disposed between the guides, and the guides are adjusted to a proper paper width position. The guides are each mounted on a rack that engages a centralized pinion gear disposed in the cover plate that is closed over the printer housing. Rotation of the pinion gear draws the paper mounting guides toward and away from each other, thus justifying the roll. The spaced-apart guides are biased towards each other within the cover cavity by means of a tensioned, coil spring. The spring is attached to a rack supporting one of the paper holders on one distal end, and to the cover plate on the other distal end.

A mechanism is attached to the hinge of the cover plate, which locks the paper adjustment guides in place when the cover plate is closed over the internal, paper receiving cavity. The locking mechanism comprises a hinge pin that fits in the hinge of the cover plate. The hinge pin is fixed to the frame or housing of the printer, and comprises a camming surface. A pawl disposed in the cover plate is engaged by the camming surface of the hinge pin as the cover plate is closed over the paper receiving cavity. The pawl pushes against a second set of racks attached to the supply roll guides. The second set of racks are locking racks that comprise a fine mesh of teeth. The teeth, when mated together, prevent the guides from moving apart with respect to each other. These racks lock the supply roll guides in their paper size adjusted position.

It is an object of this invention to provide an improved paper adjustment mechanism for a label printer.

It is another object of the invention to provide a paper adjustment and locking mechanism for a label printer that automatically locks the width adjustment of the paper roll when the cover plate of the label printer is closed over the printer housing.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components shall bear the same numbering and designations throughout the figures.

DESCRIPTION OF THE PREFERRED EMBODIMENT

Generally speaking, the invention features a mechanism for a label printer that automatically lock s two, spaced-apart paper supporting guides. A supply roll of paper is disposed between the guides, and the guides are adjusted to a proper paper width position. The guides are each mounted on a rack that engages a centralized pinion gear disposed in the cover plate that is closed over the printer housing. The guides are locked in an adjusted position when the cover is latched to the housing of the label printer.

Figure 1:
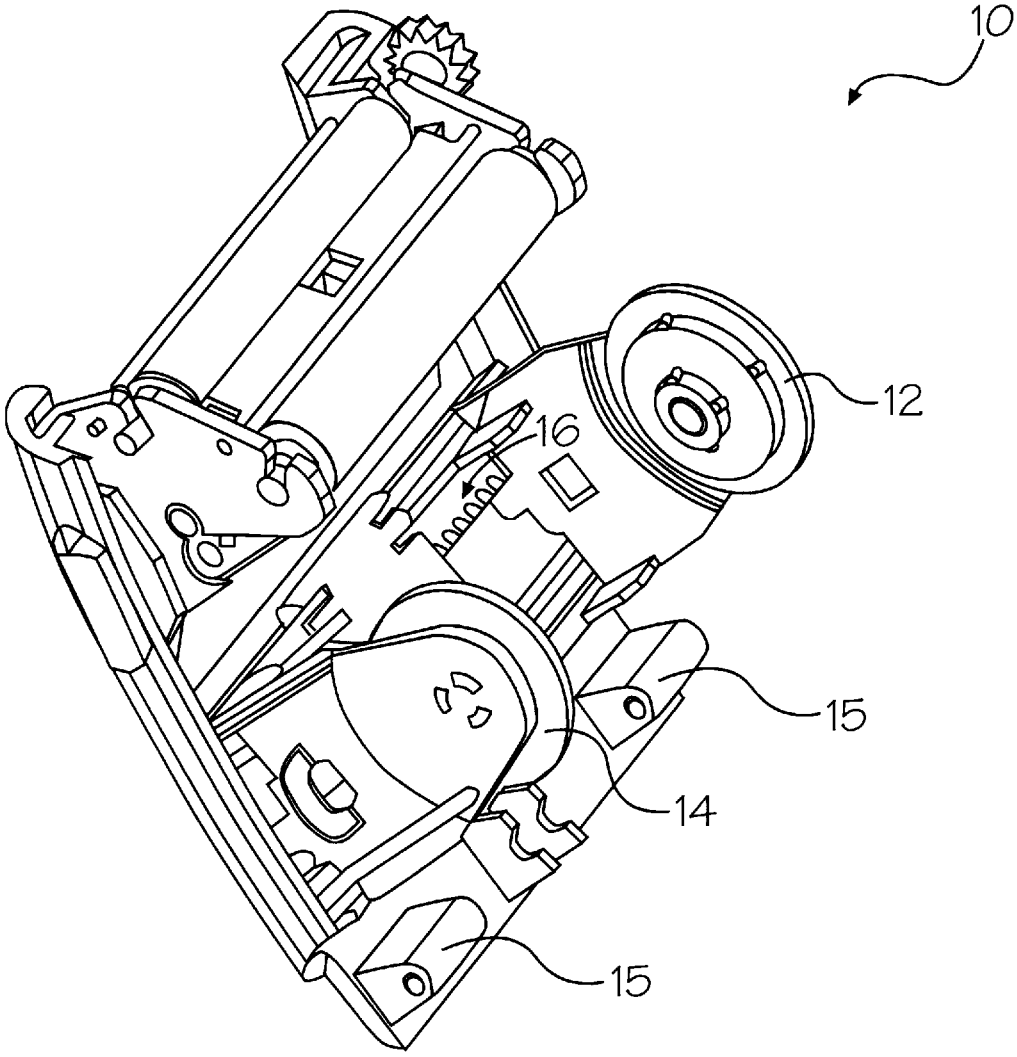
FIG. 1 illustrates a perspective view of the cover plate and paper adjustment mechanism of this invention.

Now referring to FIG. 1, a cover plate 10 for the housing of a label printer is illustrated. Adjustable guides 12 and 14, respectively, are designed to hold a roll of thermal printing paper (not shown). A rack-and-pinion gear system (arrow 16) allows the respective guides 12 and 14 to adjust to different widths of supply roll paper.

The spaced-apart guides 12 and 14 are biased towards each other within the cover cavity, by means of a tensioned, coil spring (not shown). The spring is attached to a rack supporting one of the paper holders on one distal end, and to the cover plate on the other distal end.

Figure 3:
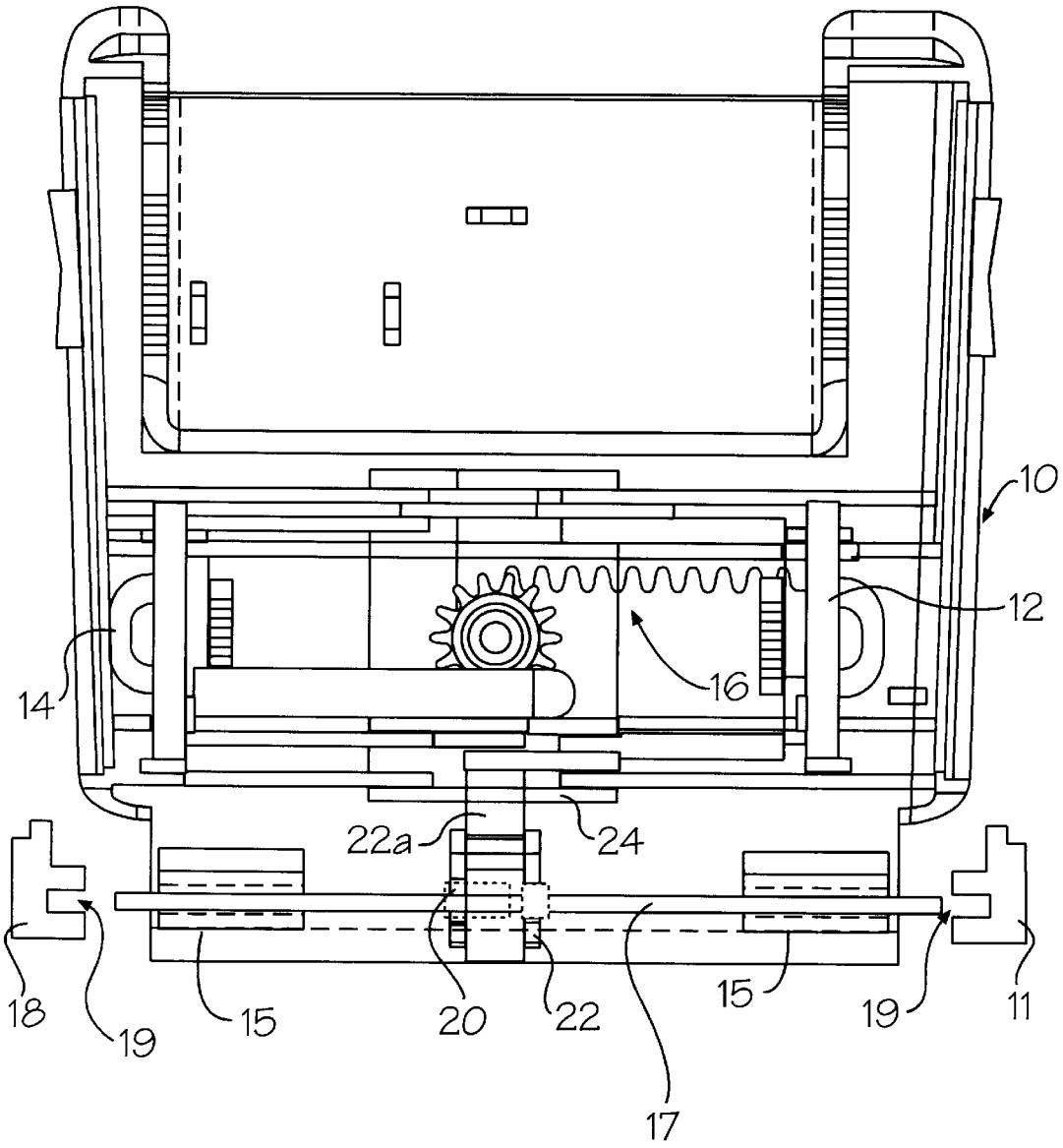
FIG. 3 shows a plan view of the cover plate and paper adjustment mechanism depicted in FIG. 1.

Two hinge members 15, disposed on the pivotal end of the cover plate 10, capture and pivot about a stationary hinge pin 17, shown in FIG. 3. Hinge pin 17 anchors in the slots 19 of the printer housing 18.

Figure 2:
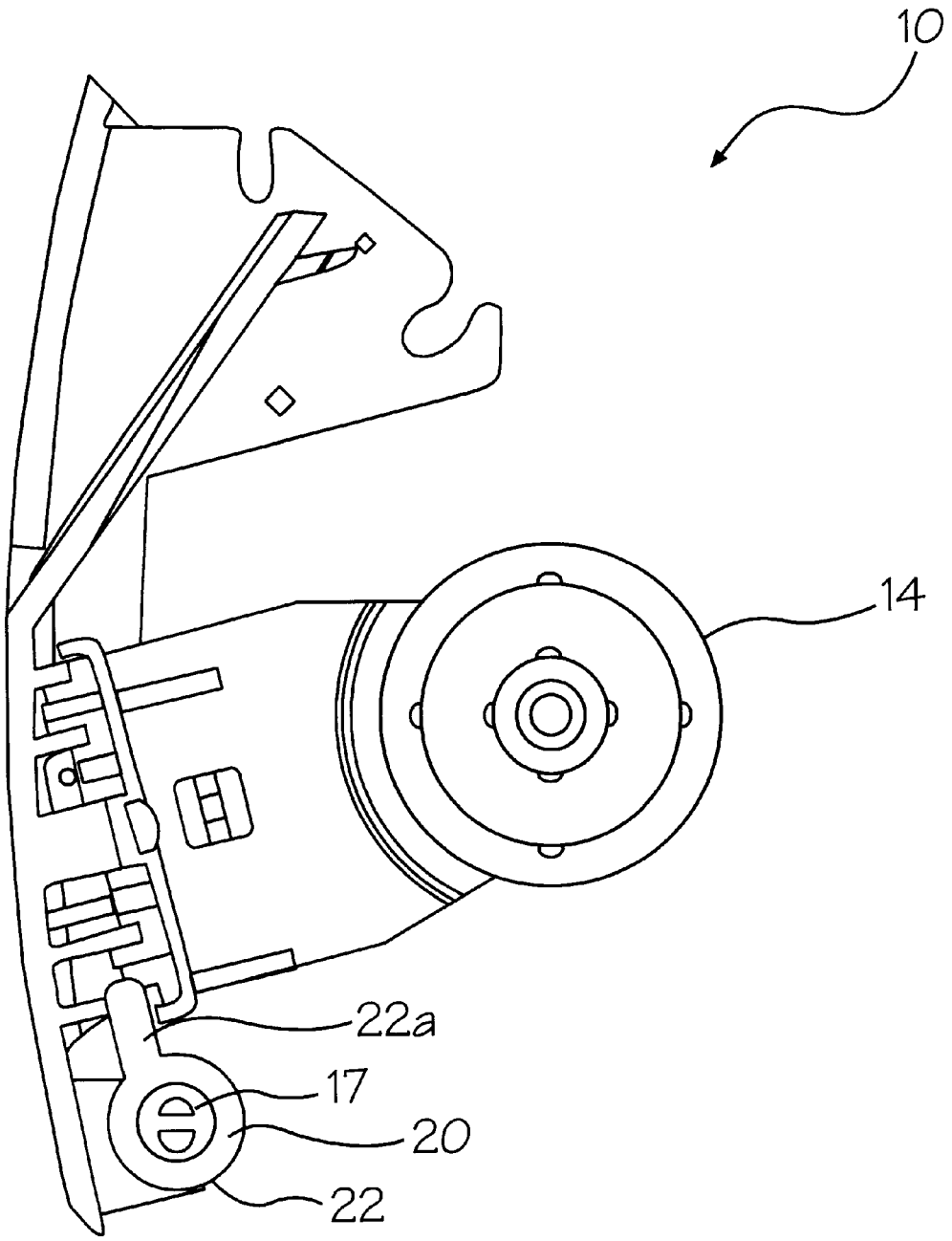
FIG. 2 depicts a sectional, side view of the cover plate aid paper adjustment mechanism shown in FIG. 1.

Referring to FIGS. 2 and 3, the cover plate 10 is shown in sectional and plan view. The hinge pin 17 is shown having a cam 20. A pawl 22 rotates on cam 20 to engage the teeth of a locking mechanism 24. The pawl 22 has an extension arm 22*a* that engages the elongated rack 26, as better seen in FIG. 4, when it rotates upon cam 20, as the cover is closed.

Figure 4:
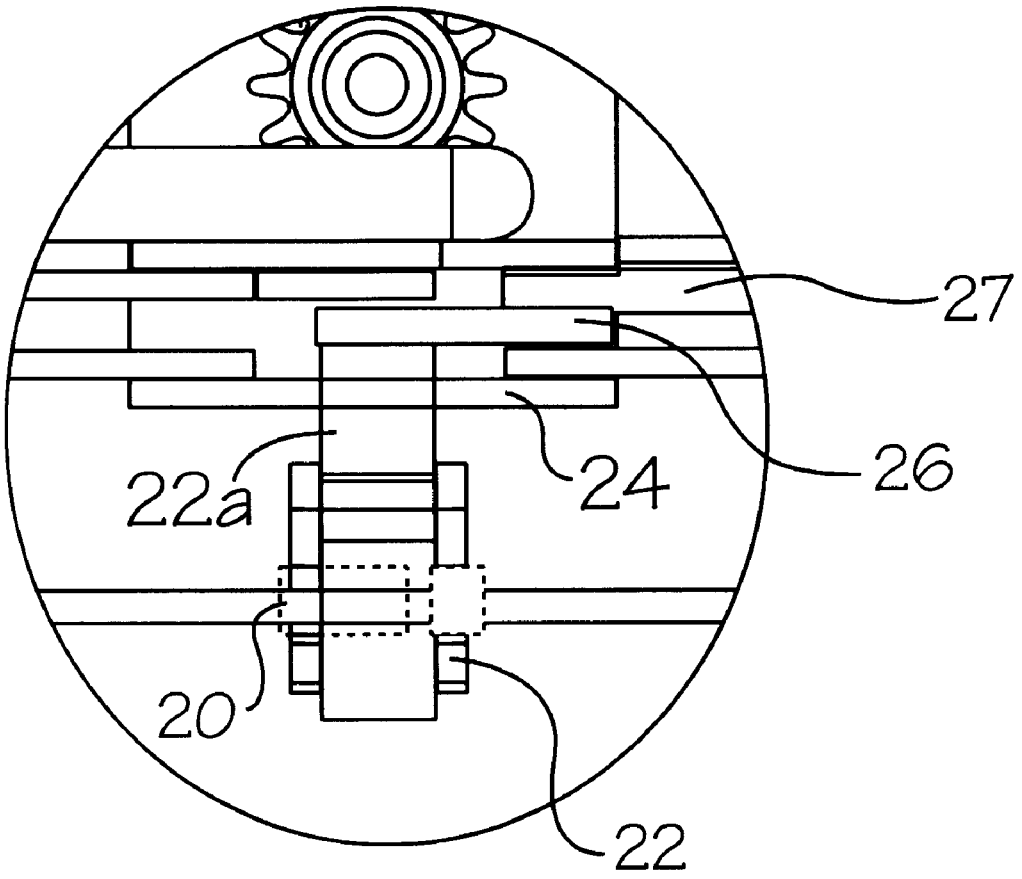
FIG. 4 illustrates an enlarged, detail view of a portion of the plan view shown in FIG. 3.

Referring to FIG. 4, an enlarged view of the locking mechanism 24 is illustrated. The locking mechanism 24 comprises elongated members 26 and 27, respectively, that have fine meshing teeth. The pawl 22 disposed in the cover plate 10 is engaged by the cam 20 of the hinge pin 17, as the cover plate 10 is closed over a paper receiving cavity. The pawl 22 has an extension arm 22*a* that pushes against elongated rack member 26, which is attached to the supply roll guide 12. The fine mesh of teeth of the rack members 26 and 27, when mated together, prevents the guides 12 and 14 from moving apart with respect to each other. These racks lock the supply roll guides 12 and 14 in their paper size adjusted position. Thus, when the cover plate 10 is latched to the print housing 18, the guides 12 and 14 are caused to become locked in their paper roll width adjusted position.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention,. what is desired to be protected by Letters Patent is presented in the subsequently appended claims.

What is claimed is:

1. A mechanism for a label printer that automatically locks two, spaced-apart, paper roll supporting guide when a cover is latched to a printer housing, comprising:

a housing for a printer;

a cover having pivot means for pivotally moving said cover with respect to said housing, said cover being pivotally movable between an unlatched and a latched position with respect to said housing;

a pair of movable paper roll guides disposed on said over, said paper roll guides having means for adjusting themselves to different paper roll sizes;

a cam supported by said pivot means on said cover;

a pawl adjacently disposed next to said cam, said pawl being caused to move when said cover pivots into said latched position with respect to said housing; and a pair of elongated rack members disposed on said cover adjacent said pair of paper roll guides, said pair of elongated rack members having fine meshing teeth that lock with respect to each other when they mate, said pawl causing said elongated rack members to mate in response to movement of said cover to said latched position, whereby said paper roll guides become locked in an adjusted paper width position.

* * * * *